United States Patent [19]

Black

[11] Patent Number: 5,076,261

[45] Date of Patent: Dec. 31, 1991

[54] MOTOR-DRIVEN THERAPEUTIC APPARATUS

[76] Inventor: William L. Black, 2800 North State Rd. #7, Margate, Fla. 33063

[21] Appl. No.: 364,028

[22] Filed: Jun. 9, 1989

[51] Int. Cl.[5] ..... A61H 7/00

[52] U.S. Cl. ..... 128/44; 128/51; 128/67

[58] Field of Search ..... 128/44, 51, 52, 33, 128/67; 74/25; 15/22 R

[56] References Cited

U.S. PATENT DOCUMENTS

| | | | |
|---|---|---|---|
| 2,128,790 | 8/1938 | Barbour | 128/52 |
| 2,831,186 | 4/1958 | Delano, Jr. | 74/25 |
| 3,504,665 | 4/1970 | Bakunin et al. | 128/52 |
| 3,511,229 | 5/1970 | Romo | 15/22 R |
| 3,724,451 | 4/1973 | Santo | 128/52 |
| 3,874,373 | 4/1975 | Sobel | 128/44 |
| 4,055,170 | 10/1977 | Nohmura | 128/33 |
| 4,722,327 | 2/1988 | Harvey | 128/44 |
| 4,790,296 | 12/1988 | Segal | 128/52 |

FOREIGN PATENT DOCUMENTS

| | | | |
|---|---|---|---|
| 2437053 | 2/1976 | Fed. Rep. of Germany . | |
| 1927563 | 10/1979 | Fed. Rep. of Germany . | |
| 86073 | 8/1955 | Norway | 128/51 |

*Primary Examiner*—Edgar S. Burr

*Assistant Examiner*—Aaron J. Lewis

*Attorney, Agent, or Firm*—Charles P. Padgett, Jr.

[57] ABSTRACT

The therapeutic apparatus of the present invention includes a portable case having a hollow interior for housing a motion-generating case or housing wherein the front end of the assembly is provided with an elongated slot for extending an elongated rod therethrough. The rod is provided with a resilient foam collar over which is mounted a penetration member adapted to penetrate a selected body orifice for providing sexual stimulation, gratification and pleasure. The motion-generating assembly within the hollow interior of the portable enclosure includes both a horizontal motion-generating assembly and a suspension assembly for producing a generally variable vertical up and down component to the motion provided by the horizontal drive assembly. An electric motor is used to drive an eccentric disk. A yoke positioned on the disk is adapted to move the elongated rod reciprocally back and forth in a generally horizontal direction. A suspension yoke positions the eccentric disk assembly in space and is suspended from the top end of a resilient support post which provides a vertical up and down component to the horizontal motion previously described. The combination of the two motions provide for continually varying strokes having different angles of penetration and angles of withdrawl for greatly increased sexual satisfaction.

58 Claims, 2 Drawing Sheets

MOTOR-DRIVEN THERAPEUTIC APPARATUS

BACKGROUND OF THE INVENTION

1. Field Of The Invention

This invention relates generally to a therapeutic apparatus, and more particularly to a motorized therapeutic apparatus for relieving tension and sexual frustration in women and/or men.

2. Description Of The Prior Art

There have always been men and women who become sexually frigid, impotent, or unable to practice normal sex for one or more reasons. For example, a woman's husband or spouse may be overly obese so as to render sex nearly impossible. Furthermore, males suffering from adult-onset diabetis may often become impotent. Yet further, users of certain medications such as anti-depressants and the like, often become impotent over long periods of time as a side effect of the medications. Still further, since men die a considerable number of years before their wives, according to today's statistics, the wife is quite often left without her normal or usual sex partner and has nowhere to turn for sexual satisfaction.

Conventional therapeutic devices available in the market place today include various types of vibrators and sex aids. Many of these sex aids require the use of another partner, either male or female. Furthermore, many do not provide the true "feel" of a male penis, and hence they do not result in true sexual gratification, enjoyment or satisfaction. Many are simply artificial, such as plastic vibrators, and cannot satisfy the true needs of a partnerless woman or male who wants not only the ultimate climax, orgasm or release but also the feeling that she or he is actually having sex with a partner.

Therefore, a long-felt, but unfulfilled, need has existed and continues to exist in the art for a therapeutic apparatus for more closely simulating sexual intercourse, anal intercourse, and the like, and which has the look and feel of a real male penis, and which can be used at any tempo, speed, or degree of gentleness or roughness, as desired by the user.

Still further, the need exists for an automatic or motorized therapeutic apparatus which can vary the stroke length, and continually and automatically vary the angle of penetration and withdrawl for even more closely resembling the conventional sex act.

The present invention solves substantially all of the problems of the prior art while avoiding any of its shortcomings.

BRIEF SUMMARY OF THE INVENTION

It is an object of the present invention to provide a therapeutic apparatus for relieving sexual tension and frustration in both men and women with or without sex partners.

It is another object of the present invention to provide a therapeutic apparatus which may utilize a continuously erect, yet resiliently pliable, artificial male penis for simulated sexual or anal intercourse wherein the penis has both the look and the "feel" of a male's erect penis.

It is a further object of the present invention to provide a motor-driven therapeutic apparatus for simulating sexual or anal intercourse which provides the required degree of gentleness or roughness, as desired by the user.

It is still another object of the present invention to provide a motor-driven apparatus for simulating sexual intercourse which is entirely under the control of the user.

It is still a further object of the present invention to provide a therapeutic apparatus which provides a continually varying angle of penetration and angle of withdrawl for even greater sexual gratification, stimulation, and satisfaction.

It is yet a further object of the present invention to provide a motor-driven therapeutic apparatus wherein the length of the stroke or depth of penetration may be selectively varied.

It is still another object of the present invention to provide a motor-driven therapeutic apparatus wherein the angle of penetration and angle of withdrawl can be continuously varied.

It is yet another object of this invention to provide a motor-driven therapeutic apparatus wherein both the length of the stroke and both the angle of penetration and the angle of withdrawl can be manually adjusted or selected by the user.

It is yet another object of the present invention to provide a motor-driven therapeutic apparatus wherein the penetration member may be selectively chosen from a plurality of penetration members, such as those found in conventional sex catalogs, adult book stores, and the like.

It is yet a further object of this invention to provide an enclosure for rendering the present apparatus easily portable.

It is still another object of the present invention to provide a portable housing for the therapeutic apparatus of the present invention which includes room for storing the disassembled components of the device and/or a plurality of interchangeable penetration members.

The present invention provides a therapeutic apparatus for relieving stress, tension, anxiety and sexual frustration in both men and women, while simultaneously providing sexual stimulation, gratification and pleasure. The sexual apparatus of the present invention includes an elongated rod having a resilient foam sleeve covering at least the front end portion thereof, and an elongated penetration sheath adapted to be removably received over at least the front end portion of the foam sleeve or collar. The penetration sheath is usually made from a rubber or latex-type material to simulate the feel of an erect male penis or the like. Furthermore, the foam collar also lends resiliency to even further approximate the true feel of an erect male penis.

The invention includes a motion-generating assembly which includes a first apparatus for horizontally reciprocating the elongated rod to drive the sheath-covered front end portion of the rod into and out of the user's selected body oriface, and a second apparatus for simultaneously producing an erratic up and down vertical component of motion for varying the angle of thrust and the angle of withdrawl of the sheath-covered end portion for substantially increased or enhanced results.

The invention also contemplates a housing or case for substantially enclosing all but a portion of the elongated rod of the present therapeutic apparatus to render it easily portable. The case may be adapted with a door or entrance for accessing the interior thereof and a plurality of different and distinct penetration sheaths may be stored therein or, alternatively, the disassembled components of the apparatus may be stored therein when not in use, or both. Even further, the casing may be provided with a sound-producing means such as a cassette deck, a tape player, a Walkman-type radio transmitter, or the like. The case may then have external speakers or an aperture for extending a cord to a pair of earphones for private listening. Even further, the enclosure may house a rechargeable battery pack or an AC adapter for running on direct current or DC power, or it may be equipped with only an electrical cord and plug for running an AC motor on AC power.

These and other objects and advantages of the present invention will become more fully understood after reading the detailed description of the preferred embodiments, the claims, and the drawings, which are briefly described hereinbelow.

DETAILED DESCRIPTION OF THE PREFERRED EMBODIMENTS

Figures 1, 4, 5:
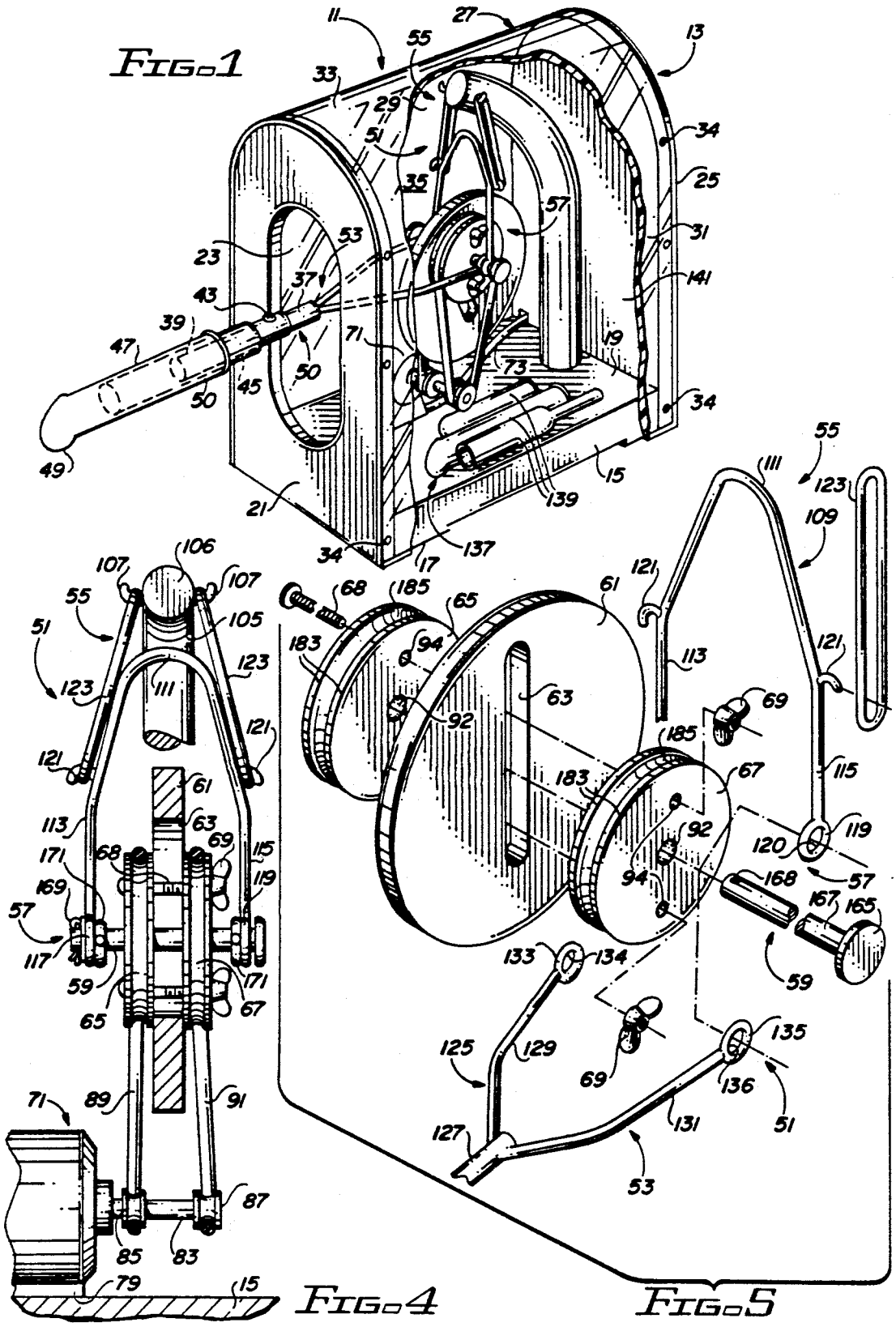
FIG. 1 shows a perspective view of the therapeutic apparatus of the present invention.
FIG. 4 is an end view of the second motion-generating apparatus of the present invention.
FIG. 5 is an exploded view of the components making up the first motion-generating apparatus of the FIG. 3.

FIG. 1 illustrates a perspective view of the motor-driven therapeutic apparatus 11 of the present invention. In FIG. 1, the therapeutic apparatus 11 is shown as including a housing or case 13 having a base or bottom 15 which includes a lower surface 17 and an upper planar surface 19. The housing 13 also includes a front panel 21 having a vertically elongated slot or aperture 23 formed therein and a rear or back panel 25. A cover 27 comprises a left side 29, right side 31, and domed or arcuate top 33. Conventional fasteners 34, such as common screws or the like, may be used to secure the front and rear edges of the cover 27 to the sides of the front panel 21 and rear panel 25. The housing or case 13 has a hollow interior 35 and, in the preferred embodiment of the present invention, the front and rear panels 21 and 25 and the bottom 15 are generally rigid solid panels whereas the cover 27 is generally comprised of a see-through clear plastic material or transparent or translucent material so that the inner workings of the apparatus can be visually observed from the exterior of the case 13.

An elongated rod or member 37 extends from the interior of the housing 13 through the elongated slot or aperture 23 of the front panel 21 and includes a rear end portion 39, a front end portion 41, and a length adjustment means 43. A resilient sleeve or foam collar 45 has a front end portion 44 and a rear end portion 46. It is generally cylindrical and has a hollow interior so that the front end portion 41 of the elongated rod 37 can be removably force-fitted into the hollow interior of the rear end portion 46 of the sleeve 45. A penetration member, sheath, or device 47 has a head or front penetration end 49, and a rear end portion 50. Typically, the penetration member 47 has a substantially hollow interior while the front or head portion 49 is closed to simulate a male penis or similar sex-stimulating device. The hollow interior of the rear end portion 50 of the penetration sheath 47 is adapted to be fitted over at least the front end portion 44 of the foam sleeve 45 to give even greater flexibility to the head portion 49 of the penetration sheath 47.

Figures 2, 3:
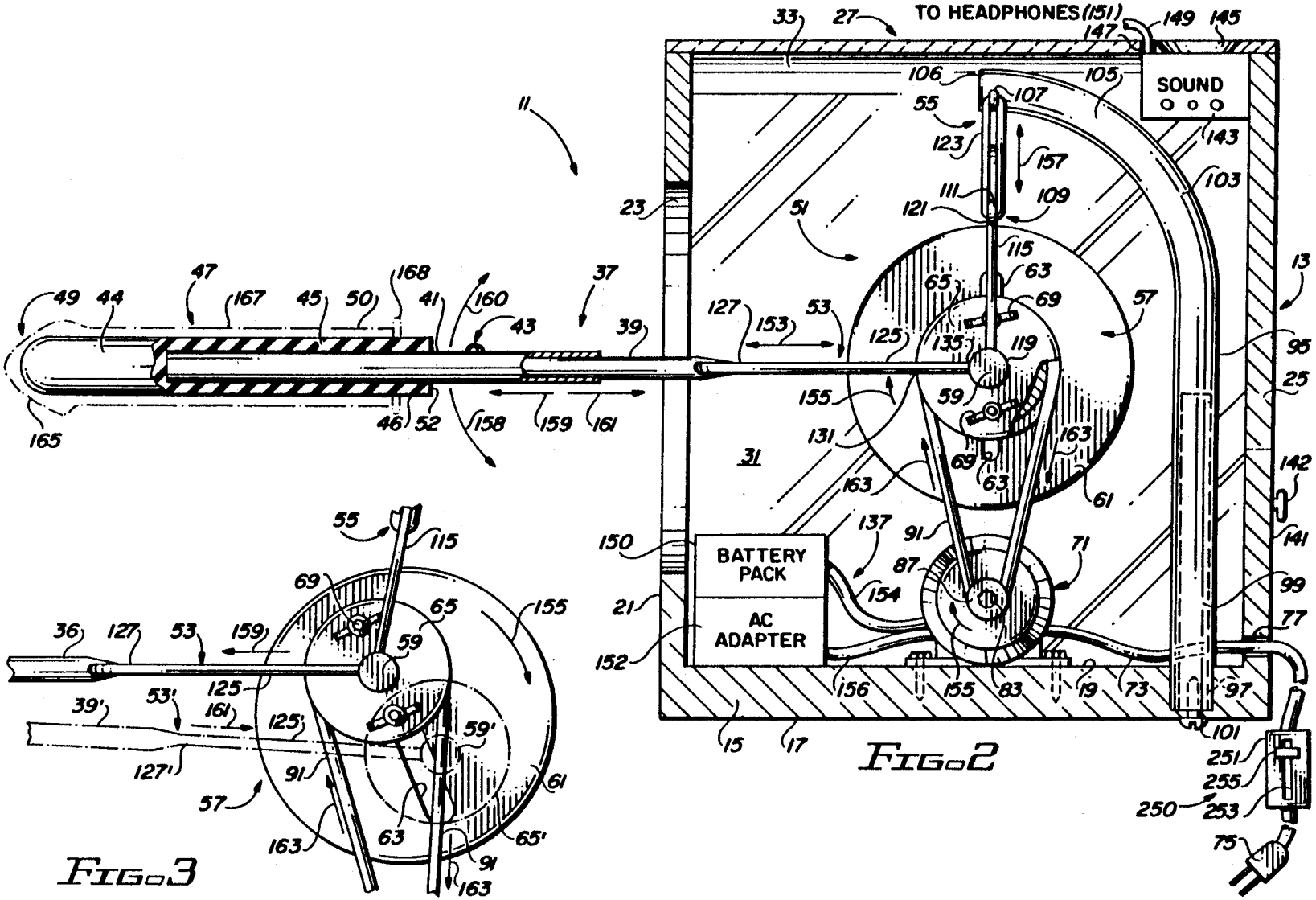
FIG. 2 is a sectional side view of the therapeutic apparatus of FIG. 1.
FIG. 3 is a side view of the first motion-generating apparatus of the present invention.

The therapeutic apparatus 11 of FIG. 1 and FIG. 2 is also shown as including a motion-generating assembly 51 which includes a horizontal drive assembly 53 and a suspension assembly 55 for providing a vertical up and down component to the motion of the horizontal drive assembly 53, as hereinafter described. The horizontal drive assembly 53 includes a drive shaft assembly 57 having a rotatable drive shaft 59, an eccentric wheel or disk 61 having an elongated wheel slot, a right pulley 65, a left pulley 67, and a threaded bolt 68 adapted to pass through an aperture 94 in the right pulley 65, through the elongated wheel slot 63 of the eccentric disk 61 and through a corresponding aperture 94 of the left pulley 67 where it engages a conventional wingnut fastener, or any conventional bolt or the like, to secure the right pulley 65, eccentric wheel 61 and left pulley 67 tightly together in a sandwich-type configuration. FIG. 1 also shows the therapeutic apparatus 11 as including a variable AC electric motor 71, as hereinafter described with reference to FIG. 2.

FIG. 2 also shows a sectional side view of the therapeutic apparatus 11 of FIG. 1 in greater detail. In FIG. 2, the therapeutic apparatus 11 is shown as including the housing or case 11 including the base 15 having a lower surface 17 and an upper planar surface 19. A front panel 21 and a rear panel 25 are also included, and the front panel 21 includes the vertically elongated slot or rod aperture 23. A cover 27 includes a left side 29, a right side 31, and a domed or arcuately shaped top 33, and the cover 27 may be secured to the top and sides of the front and rear panels 21 and 25, by conventional fasteners such as screw-type devices or the like. The housing or case 13 has a hollow interior 35 and an elongated rod 37 extends through the slot 23 of the front panel 25 to access the exterior of the housing 13.

The elongated rod 37 includes a rear end portion 39 and a front end portion 41. At least one of the front end portion 41 and rear end portion 39 may be provided with a plurality of adjustment apertures while the other of the front end portion 41 and rear end portion 39 of the rod 37 may be provided with a single aperture adapted to receive an adjustable fastener or connector 43, such as a conventional screw, pin, or the like, for enabling the length of the rod to be selectively adjustable for controlling both the depth of penetration and the length of the rod 37 itself. In the preferred embodiment of the present invention, the rear end portion 39 of the rod 37 has a first diameter "d1" while the front end portion 41 has a second diameter "d2", where "d2" "d1". Still further, the front end portion 41 has a hollow interior whose inside diameter "d3" is approximately equal to the diameter of the rear end portion 39 (d3 d1) so that the rear end portion 39 can be telescopically received within the hollow interior of the front end portion 41 and moved longitudinally therein for aligning the apertures, inserting the fastener 43 and thereby selectively adjusting the length of the elongated rod 37.

In FIG. 2, the foam sleeve or collar 45 is shown as including a front end portion 44 and a rear end portion 46. In the embodiment of FIG. 2, the front end portion 44 of the foam sleeve 45 is shown as being closed while in the embodiment of FIG. 1, the front end portion 44 of the foam sleeve 45 was shown as being open since either is appropriate for use herein. In FIG. 2, the rear end portion 46 of the foam sleeve is open, as at 52, and the sleeve 45 is provided with a substantially hollow interior extending at least partially therethrough. The hollow interior of the foam sleeve 45 is generally cylindrical, and the open end 52 of the rear end portion 46 is adapted to receive the front end portion 41 of the elongated rod 37 therein, in a force-fit manner, in order to removably secure the foam sleeve 45 to the front end portion 41 of the elongated rod 37. Preferrably, the front end portion 41 of the rod 37 extends only partially through the foam collar 45 to lend even greater resiliency to the front end portion 44 of the sleeve 45.

A penetration sheath or member 47 is shown as having a head end or front penetration end 49 and a rear end portion 50. The penetration member 47 is conventionally of a cylindrical nature and generally has a hollow interior such that at least the rear end portion 50 of the penetration member 47 can be removably force-fitted over the front end portion 44 of the foam sleeve or collar 45 and positioned thereon so that it will not come off during use. The tightness of the fit is determined by the thickness of the foam collar 45 which is selected to accomodate a plurality of different and distinct penetration members 47, each having a similarly dimensioned, generally hollow, cylindrical interior portion having approximately the same inside diameter. The head end 49 of the penetration member 47 is also shown as including a head portion 165 to further facilitate the simulation, including both the look and the feel of an erect male penis. The reciprocal back and forth motion of the elongated rod 37 is indicated by the directional motion arrows 159 and 161, and the up and down movement is indicated by the directional motion arrows 158 and 160.

FIG. 2 shows, housed within the hollow interior 35 of the housing 13, the motion-generating assembly 51 which includes a horizontal drive assembly 53 and a suspension assembly 55 which is used to add a vertical component to the motion produced by the horizontal drive assembly 53, as hereinafter described.

The horizontal drive assembly 53 includes a drive shaft assembly 57 having a rotatable driven shaft 59 on which an eccentric wheel or disk 61 is mounted for rotation therewith. The eccentric wheel or disk 61 includes an elongated wheel slot 63 which passes through the center of the disk 61. Furthermore, on one side of the eccentric wheel or disk 61, a right pulley 65 is mounted, while a left pulley 67 is mounted on the opposite side of the disk 61 and over the rotatable drive shaft 59. Each of the pulleys 65 and 67 includes one or more radially-spaced apertures 94 which are adapted to receive a fastening device, such as a conventional threaded bolt 68, therethrough. The bolt 68 also passes through the elongated wheel slot 63 of the disk 61, and conventional fasteners, such as nuts, or wingnuts 69, are threaded onto the inserted end of the bolt 68 to secure the right pulley 65, eccentric wheel or disk 61, and left pulley 67 tightly together in a sandwich-like configuration.

The horizontal drive assembly 53 also includes a variable AC electric motor 71 having an electrical connector or cord 73 which is adapted to pass from the hollow interior 35 of the housing 13 to the exterior thereof via an outlet aperture 77. The cord 73 may include a rheostat 250 or the like for enabling the user to selectively control and vary the speed of the motor 71, as known in the art. The rheostat 250 includes a case 251, an elongated slot 253 and a sliding control button 255. The opposite end of the electrical cord 73 is provided with a conventional plug 75 which can be plugged into any conventional wall socket for supplying AC power to the motor 71, as known in the art. The motor 71 includes a motor mount 79 which may be fixedly secured by screw-type fasteners 81, or the like, to the bottom panel 15 of the enclosure 13. The electric motor 71 includes a motor drive shaft 83 which extends from both sides of the motor, and a left motor pulley 85 is mounted on one side of the motor drive shaft 83 while a right motor pulley 87 is operatively mounted on the opposite side of the motor drive shaft 83. Each of the motor pulleys 85 and 87 are mounted on the motor drive shaft 83 for rotation therewith. Each includes a drive belt or band 89, 91 fitted into the corresponding pulley groove of the right motor pulley 87 and left motor pulley 85, respectively. The opposite end of the pulley drive belt 89 is operatively carried by the grooves of a pair of driven pulleys 65 and 67 for rotating the driven shaft 59, as previously described. The driven shaft 59 mounts the right pulley 65, the eccentric wheel 61, and the left pulley 67 on the rotatable driven shaft 59 in a sandwich-type fashion via the fasteners 68 and 69, as previously described. Since the opposite portion of the drive belts 89 and 91 is operatively secured within the grooves of the driven pulleys 65 and 67, respectively, the rotation of the motor drive shaft 83 rotates the motor pulleys 65 and 67, which in turn drives the belt 91 to rotate the pulleys 65 and 67, which in turn rotates the driven shaft 59 and the eccentric disk 61 mounted therewith.

The hollow interior 35 of the case 13 is also shown as including a generally vertical support post 95 having a bottom end portion 97, which may include a rigid reinforcement rod 99 which is connected or anchored to the base panel 15 via a fastener or connector 101. The bottom end portion 97 of the support post 95 may be substantially hollow to receive the rigid reinforcement rod 99 therein. The support post 95 also includes an arcuately curved intermediate portion 103, which is preferably resilient or easily bendable, and a resilient top end portion 105 terminating in a top distal end 106. Preferably, the resilient top end portion 105 of the support post 95 is curved to bend forward in the direction of the elongated slot 23 and has a pair of opposed up-turned hooks 107 mounted on opposite sides of the resilient top end portion 105 spaced a predetermined distance to the rear of the top distal end 107. An inverted U-shaped yoke assembly 109 is suspended from the hooks 107, via elastomeric bands 123, as hereinafter described. The inverted U-shaped yoke assembly 109 includes a closed end 111 operably disposed between a left leg 113 and a right leg 115. An eyelet 107 is operatively carried by the opposite end of the left leg 113 (not shown in FIG. 2) and includes an eyelet 117 having a hollow interior or aperture 118 therein, while the right leg 115 includes an eyelet 119 having a hollow interior or aperture 120.

A pair of down-turned hooks 121 are disposed on opposite sides of the legs 113 and 115, and they're adapted to retainably position elastic members or rubber bands 123 whose opposite upper ends are retained in position by the up-turned hooks 108 and 107 of the top end portion 105 of the support post 95. A generally Y-shaped yoke 125 has a leg 127, a left arm 129, and a right arm 131. The right arm 131 is provided with an eyelet 133 having a central aperture 134 therethrough (not shown in FIG. 2), while the left arm 129 terminates in an eyelet 135 having a central aperture 136.

The hollow interior 35 of the housing 113 may also be provided with a storage area 137 located on the top surface 19 of the base panel 13 and, as shown in FIG. 1, it may be used to store a plurality of different and distinct interchangeable penetration members 47 or, alternatively, the disassembled rod-end of the apparatus, when not in use. Furthermore, one or more of the panels, such as the rear panel 25, may by provided with an access door 141 having a knob 142 or the like which can be openable to gain access to the hollow interior 35 of the housing or case 13. This will enable the user to remove the rod-like member for reassembly or to select a different and distinct one of the penetration members 47 desired for use at a particular time or for a particular purpose. Furthermore, the hollow interior 35 may include electrical sound producing devices such as a radio, tape deck, tape player, CD, or the like, which can feed the sound to the external area via speakers 145 or via an electrical connector 149 and an outlet port 147 to a pair of earphones 151.

The hollow interior 35 may also include a rechargeable battery pack 150 and/or an AC adapter 152 for powering a DC motor or, as in the preferred embodiment, the electrical cord 73 can provide electrical power from the wall socket and plug 75 directly to the AC motor 71 for operating same. The bi-directional horizontal motion arrow 153 shows the bi-directional, generally horizontal movement of the Y-shaped yoke 125 driving the elongated rod 37 and powered by the horizontal motion-generating assembly 53. The directional arrow 155 shows the rotational direction of the shaft 59, pulley 65 and disk 61, while the vertical bi-directional arrow 157 shows the motion of the inverted U-shaped yoke 119 suspending the horizontal drive assembly 53 via the suspension assembly 55. Directional arrows 163 show the direction of rotation of the pulley drive belt 91.

Lastly, the penetration member 47 is shown as including a bulbous head 165, an elongated cylindrical body 167 having an aperture or opening 168 in the rear end thereof for fitting the foam collar 45 into the hollow interior thereof.

FIG. 3 shows, in greater detail, the horizontal drive assembly 53 of FIGS. 1 and 2. In FIG. 3, the position of the drive shaft assembly 57 including the rotatable driven shaft 59, the eccentric wheel or disk 61, and the driven pulleys 65 and 67 are shown in solid lines in a position of forward thrust as indicated by the directional arrow 159 and, in a position of withdrawl as indicated by the directional arrow 161 in phantom lines. The corresponding components of the horizontal drive assembly 53 in the forward thrust position are indicated by the previously given reference numerals, while the components in the withdrawling position are indicated by the use of a prime symbol (') after the corresponding reference number. Since the driven shaft 59 is suspended from the top of the support post 95, it is free to move as the drive belt 91 rotates the pulley 65. The rotation of the pulley 65 turns the shaft 59 and hence the eccentric disk 61 mounted thereon. Since the driven shaft 51 is disposed along the longitudinal slot 63 of the disk 61 and spaced a predetermined distance from the center of said disk 61, it can be seen that as the belt 91 rotates, as shown by the directional arrow 163, the disk 61 rotates in a clockwise direction as shown by the directional arrow 155 causing the forward movement of the rod 39 during one half of the rotation cycle of the disk 61 and the withdrawl of the rod 39 during the opposite half cycle of rotation of the disk 61. It is by this method that the horizontal drive assembly 53 operates to reciprocally move the elongated rod 37 in a generally horizontal back and forth motion for thrusting forward for penetration and then moving backward for withdrawl.

FIG. 4 shows the overall motion generator 51 with the horizontal drive assembly 53 and the suspension assembly 55 in greater detail. It will be seen that as the electric motor 71 rotates the motor drive shaft 83, the motor drive pulleys 85 and 87 will be rotated therewith. The rotation of the motor pulleys 85 and 87 will rotate the drive belts 89 and 91, respectively, to drive the driven pulleys 65 and 67, respectively, of the drive shaft assembly 57. Since the eccentric disk 61 is sandwiched between the inside surfaces of the pulleys 65 and 67, and all are mounted on the driven shaft 59, the entire assembly rotates with the rotation of the motor drive shaft 83 and the position of the drive shaft within the elongated slot 63 and, in fact, the distance it is positioned away from the center of the disk 63 determines the length of the horizontal back and forth motion or stroke of the elongated rod 37 via the Y-shaped yoke assembly 125 as previously described.

It will be noted that the entire drive shaft assembly 57 is suspended by the suspension assembly 55. The hooks 107 on opposite sides of the top end portion 105 of the support post 95 are connected via rubber bands or suspension means 123 to the down-turned hooks 121 operatively disposed intermediate the legs 113 and 115 of the inverted U-shaped yoke assembly 109. Since the opposite ends of the legs 113 and 115 have their eyelets 117 and 119, respectively, mounted to the drive shaft assembly 57 via the insertion of the threaded member 68 through the eyelet apertures 118 and 120, respectively, the entire drive shaft assembly 57 is supported or suspended in space therefrom. The threaded member 68 is used to sandwich the pulleys 65, 67 and the disk 61 together, while the driven shaft 59 may be provided with a head at one end and an aperture at the opposite end adapted to receive a cotter pin or similar connection device 169 for securing the drive shaft assembly 57 and the suspension assembly 55 together.

FIG. 5 shows an exploded view of the horizontal drive assembly 53 of the present invention plus portions of the suspension assembly 55. In FIG. 5, the inverted U-shaped yoke 109 is shown as including a closed end 111, a left leg 113 and a right leg 115. The intermediate portion of each of the legs 113 and 115 are provided with an outwardly disposed pair of downwardly curved hook members 121 which are adapted to engage one end of the elastomeric or rubber band loop 123 while the opposite end is suspended from the top of the support post 95 as previously described. The opposite ends of the legs 113 and 115 terminate in a pair of eyelets 117 and 119 having hollow interiors or eyelet apertures 118 and 120, respectively. The apertures 118 and 120 of the eyelets 117 and 119 are adapted to be received over the elongated body portion 167 of the driven shaft 59 which is shown as having a head 165 and an aperture 168 in the opposite end of the elongated shaft 167. The shaft 59 is adapted to be received through the apertures 92 of the driven pulleys 65 and 67 as well as through the eyelets 117 and 119 before a fastening device, such as the cotter pin of FIG. 4, is passed through the aperture 168 to retain the drive shaft assembly 57 rotatably mounted on the driven shaft 59. The threaded members 68 are shown as being passable through the apertures 94 of the pulleys 65 and 67 and to secure the pulleys 65 and 67 on opposite sides of the eccentric wheel 61 in a tight sandwich-type configuration via wingnuts 69.

The driven pulleys 65 and 67 are shown as including a pair of oppositely disposed peripheral ridges 183 forming a hollow belt housing depression 185 therebetween as conventional with pulleys of this sort. Lastly, the Y-shaped yoke 125 is shown as having the leg 127 extending in a forward direction so as to be connectable to or integral with the distal rear end of the rear end portion 39 of the elongated rod 37 and a pair of oppositely disposed arms 129 and 131 each terminating in an eyelet 133, 135, respectively, and an eyelet aperture 134, 136, respectively. The eyelets 133 and 136 are also adapted to be engaged by the driven shaft 59 by the elongated central portion 167 passing through the apertures 134 and 136 of the eyelets 133 and 135, respectively, as were connected the eyelets 117 and 119 of the inverted U-shaped yoke 109.

It will be understood that the material used to form the various panels of the housing 13 can be any rigid material including plastic, wood, metal or the like and the cover 27 may include any similar material, although, in the preferred embodiment of the present invention, a generally transparent plastic material is contemplated. Any types of fastener means may be used, as conventionally known in the art, or substituted for any of the fastening means discussed herein. It will further be understood that the particular design, shape, function, and the like of the penetration sheath can be chosen from a wide plurality of such sheaths commercially available in any adult catalog, adult book store, or the like today.

The dimensions of the unit and the dimensions of the elongated front aperture, are not critical to the present invention and need only be sufficient to serve their intended functions. It will further be noted that the length of the stroke can be changed by increasing the radius at which the driven shaft 59 is positioned within the elongated slot 63. The length can also be selectively varied by the length adjustment means 43 on the elongated rod 37. The amount of up and down component of motion added to the horizontal motion can be varied by altering the resiliency of the support post or the elasticity of the rubber suspension bands 123. The material of the driven pulleys, the drive pulleys, and the eccentric disk can also be metal or plastic, and the motor may be AC or DC, although an AC variable speed motor was chosen in the preferred embodiment of the present invention. Similarly, various means can be used to drive the motors, as known in the art.

It will, of course, be recognized by those of ordinary skill in the art that various modifications, variations, substitutions, changes, and alterations can be made in the form, structure, detail, and method of operation of the present invention without departing from the actual spirit and scope of the present invention, which is limited only by the appended claims.

I claim:

1. A therapeutic apparatus for relieving stress, tension, anxiety and sexual frustration in both women and men, while simultaneously providing sexual stimulation and pleasure, comprising:

an elongated rod having a front end portion and a rear end portion;

a resilient foam cover means for covering at least said front end portion of said elongated rod, said resilient foam cover means including a front end portion and a rear end portion;

an elongated penetration sheath means adapted to be removably received over at least said front end portion of said resilient foam cover means for producing a sheath-covered operative end portion;

a motion-generating assembly including:

(1) a first means for horizontally reciprocating said elongated rod to drive said sheath-covered front end portion of said rod into and out of a user's selected body orifice; and (2) a second, separate and distinct means for freely suspending said first means in space and for simultaneously producing an erratic up and down vertical component of motion for erratically varying the angle of thrust and the angle of withdrawal of said sheath-covered front end portion of said elongated rod for substantially improved results.

2. The therapeutic apparatus of claim 1 further including housing means for substantially enclosing at least said rear end portion of said elongated rod and all of said motion-generating assembly therein.

3. The therapeutic apparatus of claim 2 wherein said housing means includes:

a generally rectangular base member having a relatively flat upper surface and a lower surface;

a front panel having opposite sides and a top;

a rear panel having opposite sides and a top;

cover means operatively extending from the longitudinal sides of said base member, along said opposite sides of said front and rear panels, and over the tops thereof for producing an enclosed case having a substantially hollow interior;

fastener means for operatively securing said cover means to said base member and to said front and rear panels; and an elongated slot operatively disposed in said front panel and vertically oriented for reciprocally receiving said rear end portion of said elongated rod therethrough.

4. The therapeutic apparatus of claim 3 wherein said cover means includes a generally transparent material.

5. The therapeutic apparatus of claim 4 wherein said generally transparent material includes a relatively clear see-through transparent material.

6. The therapeutic apparatus of claim 3 wherein said hollow interior of said enclosed case includes a storage area for temporarily receiving and storing at least one of said sheath means therein, and wherein at least one of said base member, front panel, rear panel, and cover means includes means for accessing said storage area for at least one of storing said at least one sheath means and removing same for use.

7. The therapeutic apparatus of claim 6 wherein said at least one sheath means includes a plurality of different and distinct sheath means for different and distinct uses and sensations.

8. The therapeutic apparatus of claim 3 wherein said hollow interior of said enclosed case includes sound-producing means.

9. The therapeutic apparatus of claim 8 wherein said soundproducing means includes at least one of a radio, tape unit, minitape unit, and compact disk player or CD.

10. The therapeutic apparatus of claim 9 wherein said soundproducing means further includes at least one of speakers and earphone speaker means.

11. The therapeutic apparatus of claim 1 wherein said elongated rod is relatively rigid.

12. The therapeutic apparatus of claim 11 wherein said elongated rod includes metal.

13. The therapeutic apparatus of claim 1 wherein said elongated rod includes a resiliant material.

14. The therapeutic apparatus of claim 13 wherein said resilient material includes an elastomeric plastic material which is at least bendable.

15. The therapeutic apparatus of claim 1 wherein said elongated rod is generally hollow cylindrical member and includes a first portion having a first diameter, a second portion having a second diameter, wherein said first diameter is greater than said second diameter, and wherein said second diameter portion is adapted to be longitudinally slidably received within said hollow interior of said first diameter portion for selectively varying the length of said elongated rod.

16. The therapeutic apparatus of claim 15 wherein said elongated rod further includes locking means for adjustably securing said second diameter portion at a given distance within said hollow interior of said first diameter portion and locking same for length adjustment purposes.

17. The therapeutic apparatus of claim 1 wherein said elongated rod includes means for selectively adjusting the longitudinal length thereof.

18. The therapeutic apparatus of claim 1 wherein said resilient foam cover means includes a hollow cylindrical foam member which is resiliently bendable and soft to the touch.

19. The therapeutic apparatus of claim 18 wherein said hollow cylindrical foam member is closed at its front end portion and open at its rear end portion.

20. The therapeutic apparatus of claim 18 wherein the front end portion of said hollow cylindrical foam member is not received over the front end portion of said elongated rod but extends outwardly therefrom to provide additional flexibility and bendability and a more natural feel to the sheath means received thereover.

21. The therapeutic apparatus of claim 1 wherein said sheath means is shaped like an erect male penis.

22. The therapeutic apparatus of claim 1 wherein said sheath means includes a cleanable, relatively sterile, and generally resilient material.

23. The therapeutic apparatus of claim 22 wherein said sheath means includes a latex-type rubber-like material.

24. The therapeutic apparatus of claim 1 wherein said sheath means includes a plurality of generally resilient, interchangeable penetration members for providing a plurality of different and distinct uses, sensations, and effects.

25. The therapeutic apparatus of claim 1 wherein said first motion-generating means includes:

a rotatable shaft;

means mounted on said rotatable shaft for horizontally and reciprocally driving said elongated rod as said shaft rotates;

means for operatively coupling said rear end portion of said elongated rod to said shaft-mounted means; and means for rotatably driving said shaft.

26. The therapeutic apparatus of claim 25 wherein said shaftmounted means includes:

an eccentric disc having an elongated slot diagonally through the center thereof and extending a greater distance to one side of said center than to the opposite side thereof, said slot being adapted to receive said rotatable shaft therethrough; and means for mounting said eccentric disc on said rotatable shaft such that said shaft passes through a portion of said elongated slot which is off the center of said disc.

27. The therapeutic apparatus of claim 26 wherein said means for rotatably driving said shaft includes a pair of pulleys mounted on said shaft on opposite sides of said eccentric disc and means for securing said pulleys and said disc together to sandwich said eccentric disc between said pulleys.

28. The therapeutic apparatus of claim 27 wherein said means for rotatably driving said shaft includes:

motor means for rotatably driving said rotatable drive shaft; and means for coupling said rotatable drive shaft to each of said pulleys for rotatably driving said pulley therewith.

29. The therapeutic apparatus of claim 27 wherein said motor means includes a DC motor and at least one of a set of rechargable battery means and an AC adapter means for driving said DC motor.

30. The therapeutic apparatus of claim 28 wherein said motor means includes an AC motor.

31. The therapeutic apparatus of claim 30 wherein said AC motor is a variable speed motor and includes an electrical cord having one end electrically coupled to said AC motor and its opposite end including an electrical plug adapted to be inserted into a conventional electric outlet for powering said motor.

32. The therapeutic apparatus of claim 28 wherein said means for coupling said rotatable motor means drive shaft to each of said pulleys includes a pair of spaced apart motor pulleys operatively mounted on said motor drive shaft and a pair of pulley drive means operatively coupling said pair of motor drive pulleys to said pair of shaft-mounted pulleys for rotatably driving same.

33. The therapeutic apparatus of claim 27 wherein said means for operatively coupling said rear end portion of said elongated rod to said shaft-mounted means includes a generally Y-shaped yoke means having its relatively short base at least one of connected to and integral with the rear end portion of said elongated rod, and a pair of rearwardly extending arms originating at said base, each of the distal rear end portions of said pair of rearwardly extending arms having eyelet means adapted to be operatively received over said rotatable shaft and disposed a predetermined distance outward of said pair of pulleys mountED thereon.

34. The therapeutic apparatus of claim 27 wherein said apparatus includes a mounting base member and wherein said second motiongenerating means includes:

an elongated support post having a lower end portion adapted to be relatively rigid and removably secured to said base member, a generally resilient top end portion, and an intermittent arcuately curved, forwardly disposed, bendable portion; and hanger means operatively coupled to the top end portion of said support post for vertically suspending said shaft-mounted means therefrom such that the resiliency of said top and intermediate portions of said support post enable said suspended shaft-mounted means to move erratically vertically up and down for changing the thrust and withdrawl angles of said sheath-covered front end portion of said rod.

35. The therapeutic apparatus of claim 34 wherein said hanger means includes:

a pair of upwardly curved, hook-like members operatively mounted on said top end portion of said support post;

a generally inverted, U-shaped yoke means having a closed upper end portion and a pair of downwardly disposed, elongated, spacially separated leg portions extending vertically downward therefrom, said pair of elongated leg portions having an upper integrally joined portion, an intermediate portion and a pair of downwardly disposed distal end portions, each of said distal end portions including eyelet means adapted to be operatively received over opposite ends of said rotatable shaft and being operably disposed thereon outwardly of said eyelet means of said Y-shaped yoke means, and a pair of downwardly-curved hook-like members operatively disposed along said intermediate portion of said downwardly distended leg portions; and a pair of resilient band means operatively coupling said pair of upwardly curved hook-like members of said support post to said downwardly curved hook-like members of said inverted U-shaped yoke means for freely suspending said eccentric disk, said pulleys, said drive shaft and said Y-shaped yoke means therefrom.

36. The therapeutic apparatus of claim 34 wherein said rotatable shaft includes a pin member having an elongated cylindrical body, an enlarged head at one end thereof, and an aperture disposed adjacent the opposite end, said aperture being adapted to receive a fastener means therein for securing said eccentric disc, said pulleys, and said eyelet means on said rotatable shaft for rotation therewith.

37. The therapeutic apparatus of claim 1 further including:

housing means for providing an enclosed hollow interior and including a front having a generally vertical, central, elongated slot means for communicating said hollow interior with the housing exterior; and wherein said first motion-generating means includes:

a main drive shaft;

an eccentric wheel having an elongated diagonal slot passing through the center thereof, said slot being adapted to receive said main drive shaft therethrough at a location displaced radially outward of said center to provide an eccentric motion effect as said main drive shaft rotates;

a pair of first pulley means adapted to be mounted on said main drive shaft on opposite sides of said eccentric wheel for rotation with said main drive shaft;

means for securing said pair of first pulley means to opposite sides of said main drive shaft on said eccentric wheel for rotation therewith;

a motor drive shaft;

motor means for rotatably driving said motor drive shaft;

a pair of motor pulley means operatively mounted in a space relationship on said motor drive shaft for rotation therewith;

belt means operatively mounted on each of said pair of motor pulley means and a corresponding one of each of said pair of said first pulley means, respectively, for rotatably driving said main drive shaft and the elements mounted thereon; and wherein said second motion-generating means includes means for elastically suspending said first motion-generating means freely in space and substantially entirely within said hollow interior of said housing.

38. The therapeutic apparatus of claim 37 wherein said housing means further includes:

a bottom having a surface adapted to be placed on a substantially flat surface and a top surface disposed substantially entirely within the hollow interior of said housing;

a rear disposed opposite said front and shaped substantially identically thereto; and a top operatively disposed over the sides and tops of said front and said rear for enclosing said hollow interior, said top including a relatively clear plastic means for enabling said hollow interior to be visually observed therethrough.

39. The therapeutic apparatus of claim 38 wherein said second motion-generating means and said means for elastically suspending said first motion-generating means includes:

a generally vertical support member having a relatively rigid lower end portion adapted to be anchored to said base of said housing and a relatively flexible and resiliently bendable upper end portion arcuately curved toward and operatively disposed over said first motion-generating means;

first fastening means operatively disposed adjacent said distal top end portion of said support member;

an inverted, generally U-shaped member having a pair of downwardly distending, symetrically opposite, spacially separated, elongated legs each having a top end portion, an intermediate portion, and a lower distal end portion, and an arcuately integral intermediate portion interconnecting said top end portions of said elongated legs;

second fastening means operatively carried by said intermediate portion of each of said pair of elongated legs; and connector means operatively disposed on said lower distal end portions of each of said legs for operatively connecting same to said main drive shaft fastening means of said support member and said second fastening means of said inverted, generally U-shaped member for hangably suspending said first motion-generating means freely in space within said hollow interior of said housing means so as to generate a generally vertical, up and down elastic motion component to the reciprocating motion of said elongated rod as said main drive shaft rotates.

40. The therapeutic apparatus of claim 39 wherein said motion-generating assembly further includes:

a generally Y-shaped yoke means for operatively coupling said rear end portion of said elongated rod to said first means, said yoke means including an outwardly disposed central leg and a pair of inwardly disposed diverging arm members, each of said arm members being spacially separated from one another and including a shaft connection means for operatively mounting the distal inner ends of each of said arms to opposite ends of said main drive shaft for rotation therewith, said coupling means being operatively mounted on opposite sides of said main drive shaft-mounted first pulley means, and outwardly thereof but inwardly of said connector means of said inverted U-shaped member and means for operatively coupling the distal end portion of said central leg to said rear end portion of said elongated rod for reciprocally driving same with a vertically up and down component of motion for varying the angle of thrust and the angle of withdrawal of the front end portion of said elongated rod as it passes into and out of the user's selected body orifice.

41. A therapeutic sex machine for use by sexually-frustrated persons comprising:

a box-like housing having a base, a front portion, a rear portion, a pair of opposite side portions, and covering means operatively disposed over said front, rear and opposite side portions for providing a substantially enclosed hollow interior;

said front portion including means for forming an aperture therethrough;

a first rotatable drive shaft;

an eccentric wheel including means for mounting said wheel eccentrically on said first rotatable drive shaft;

means for rotatably driving said first rotatable drive shaft and said eccentric wheel mounted thereon;

an elongated, generally horizontally disposed, rod-like member having a front end portion and a rear end portion;

means for operatively coupling said rear end portion of said elongated rod-like member through said aperture of said front portion of said box-like housing and to said first rotatable drive shaft for moving said elongated rod-like member reciprocally back and forth in a generally horizontal manner as said eccentric wheel rotates about its eccentric axis;

means for spacially suspending said eccentric wheel and said first rotatable drive shaft vertically within said hollow interior of said housing and for simultaneously imparting an erratic, vertical, up and down movement thereto for varying the angle of thrust and the angle of withdrawal of said elongated rod-like member for enhanced stimulation and pleasure;

a generally resilient, foam-like, substantially hollow sleeve means operatively covering at least said front end portion of said elongated rod-like member to provide a natural feel thereto, said resilient foam-like sleeve means having an open rear end portion for communicating with said hollow interior thereof and being adapted to telescopically receive therein at least said front end portion of said elongated rod-like member and said sleeve means also having a front, orifice-penetrating end; and sheath means having a closed front end portion, an open rear end portion, and a substantially hollow interior and being adapted to have said open rear end portion removably and telescopically received over said sleeve-covered front end portion of said elongated rod-like member for providing sexual stimulation, relaxation, and pleasure to the user thereof.

42. The therapeutic sex machine of claim 41 wherein said means for rotatably driving said first rotatable drive shaft and said eccentric wheel mounted thereon includes:

a second drive shaft;

motor means for rotatably driving said second drive shaft;

a first pair of pulleys operatively mounted at spaced apart positions on said second drive shaft for rotation therewith;

a second pair of pulleys operatively mounted on said first rotatable drive shaft on opposite sides of said eccentric wheel;

fastener means for securing said second pair of pulleys toward one another so as to sandwich said eccentric wheel therebetween for rotational movement therewith on said first rotatable drive shaft;

a first belt-like drive means operatively coupling a first one of said first pair of pulleys to a corresponding first one of said second pair of pulleys, respectively; and a second belt-like drive means operatively coupling a second one of said first pair of pulleys to a corresponding second one of said second pair of pulleys.

43. The therapeutic sex machine of claim 42 wherein said suspending means further includes:

a vertically upright support post having a bottom end portion and means for anchoring said bottom end portion to said base of said box-like housing, a top end portion, and an intermediate portion therebetween, at least said top end portion and said intermediate portion being generally flexible and resilient, said top end portion being arcuately disposed forward of said rear portion of said housing and generally over and above said eccentric wheel;

fastening means operatively coupling the top end portion of said support post to said first rotatable drive shaft for producing a generally vertical up and down movement thereof as said first rotatable drive shaft rotates;

an inverted U-shaped member having an integral closed portion and a pair of spacially separated leg portions distending downwardly therefrom, each of said leg portions terminating in eyelet means adapted to be received over opposite ends of said first rotatable drive shaft on opposite sides of said second pair of pulleys and spaced outwardly therefrom; and means for resiliently hangably suspending said inverted U-shaped from said top end portion of said support post for resilient suspension purposes.

44. The therapeutic sex machine of claim 43 wherein said top end portion of said support post includes:

a pair of generally, upwardly turned, hook-like members operably disposed on opposite sides thereof and wherein said intermediate portion of said pair of leg portions of said inverted U-shaped member include a second pair of downwardly turned hook-like members; and wherein said suspending means includes:

a pair of generally resilient elastic band means, one of said band means being adapted to be connected between one of said pair of hook-like members disposed on said top end portion of said support post and a corresponding one of said pair of hook-like members disposed on said intermediate portion of said pair of leg portions while the opposite one of said pair of elastic band means is adapted to be connected between the other one of said pair of hook-like members disposed on said top end portions of said support post and a corresponding opposite one of said pair of hook-like members disposed on said intermediate portion of said pair of leg portions, respectively, for resiliently hangably suspending said inverted U-shaped member from said support post so as to produce a substantially generally vertical, substantially erratic, up and down component of said reciprocal motion for changing the angle of penetration and the angle of withdrawal of said elongated rod-like member as said eccentric wheel rotates.

45. The therapeutic sex machine of claim 42 wherein said means for operatively coupling said rear end portion of said elongated rod-like member to said first rotatable drive shaft includes a generally Y-shaped yoke means having an elongated leg portion and a pair of spacially diverging arm portions, means for operatively connecting the distal end portion of said leg portion to said rear end portion of said elongated rod-like member, each of said arm portions terminating in eyelet means for operatively coupling same on opposite sides of said second pulley means on said first rotatable drive shaft outwardly of said pulley means and inwardly of said eyelet means of said inverted U-shaped member, said Y-shaped yoke means for suspending said elongated rod-like member in a generally horizontal position and reciprocally driving same back and forth as said first rotatable drive shaft turns.

46. The therapeutic sex machine of claim 41 wherein said covering means includes at least one of a transparent and translucent see-through type material.

47. The therapeutic sex machine of claim 41 wherein said sheath means is in the shape of an erect male penis and possesses substantially the feel and texture thereof.

48. The therapeutic sex machine of claim 41 wherein said sheath means includes at least one of a simulated male penis, and an elongated member having at least one of rubber-like wavy indentations, ridges, ripples, bumps, grooves, spikes, ring-like segments, curves, angles, stimulators, tickler tips, heads, collars, rings, ribs, anal extentions, anal probes, anal fingers, multiple ridges, extendors, double-pronged ends, bulbous heads, simulated veins, long thin extensions, short thin extensions, and the like.

49. The therapeutic sex machine of claim 41 wherein said hollow interior of said housing is adapted to removably carry a parality of different and distinct sheath means for different and distinct uses, sensations and pleasures and wherein said housing further includes means for accessing same.

50. The threapeutic sex machine of claim 41 wherein at least the front end portion of said elongated rod is flexibly bendable.

51. The therapeutic sex apparatus of claim 41 wherein said elongated rod-like member is longitudinally adjustable in length.

52. The therapeutic sex machine of claim 41 wherein said eccentric wheel includes a relatively straight, elongated, diagonal slot through the center of said eccentric wheel and means for removably securing said first rotatable drive shaft within said elongated slot at different and distinct distances from the center of said eccentric wheel for controlling the eccentricity thereof for producing different degrees of back and forth reciprocal movement and for selectively varying the stroke length.

53. A therapeutic apparatus for relieving sexual frustrations in various persons comprising:

housing means having a substantially hollow interior;

an elongated member having a front end portion and a rear end portion;

means operatively carried by said front end portion of said elongated member for achieving sexual penetration;

means operatively coupled to the rear end portion of said elongated member for producing a generally horizontal back and forth reciprocal movement of said elongated member;

means for operatively suspending said movement-producing means in space for imparting an erratic component of vertical up and down motion thereto for eccentrically varying the angle of sexual penetration and the angle of withdrawal of said penetration means for greatly enhancing the effect thereof; and means for operatively mounting at least said reciprocal movement-producing means and said suspending means substantially entirely within said hollow interior of said housing means.

54. The therapeutic apparatus of claim 53 wherein said housing means includes:

a bottom panel;

a front panel including a vertically oriented aperture centrally disposed along the vertical axis thereof;

a back panel;

said front and back panels each having side edges and an upper edge;

cover means operatively disposed above said bottom panel and over the side edges and upper edge of said front and back panels for forming said hollow interior; and wherein said movement-producing means and said suspending means are housed substantially totally within said hollow interior of said housing means.

55. The therapeutic apparatus of claim 54 wherein said cover includes a generally clear plastic material for enabling the user to visually observe the hollow interior of said housing.

56. The therapeutic apparatus of claim 53 wherein said means for achieving penetration include:

a generally cylindrical, hollow foam-like sleeve adapted to be slip-fitted over at least the front end portion of said elongated member; and a male sex organ-simulating member having a closed front end portion, an open rear end portion and a generally hollow interior adapted to be removably slip-fitted over at least the front end portion of said foam-like sleeve.

57. The therapeutic apparatus of claim 53 wherein said means for producing a generally horizontal reciprocal motion includes:

a motor having a motor drive shaft;

a main drive shaft;

an eccentric wheel operatively mounted on said main drive shaft for rotation therewith;

means operatively coupling said motor drive shaft to said main drive shaft for rotating same;

means for attaching the rear end portion of said elongated member to said eccentric wheel on said main drive shaft for imparting a generally horizontal, reciprocating, back and forth motion to said elongated member.

58. The therapeutic apparatus of claim 57 wherein said means for suspending includes:

a generally upright support means having a lower end portion operatively secured to said bottom panel and a generally resilient flexible and bendable top end portion operatively disposed above and over said eccentric wheel; and hanger means operatively coupling said top end portion of said upright support means to said main drive shaft for freely suspending same spacially within said hollow interior of said housing and for simultaneously producing a generally vertical up and down component of motion for varying the angle of penetration and the angle of withdrawal of said elongated member as it reciprocates back and forth through its cycle.

* * * * *